US005779457A

United States Patent [19]

Chuang et al.

[11] Patent Number: 5,779,457

[45] Date of Patent: Jul. 14, 1998

[54] HAND PUMP FOR PUMPING AIR OF LOWER PRESSURE AND HIGH PRESSURE

[76] Inventors: Louis Chuang, 7F-8, No. 20, Ta Lon Road, Taichung, Taiwan; Scott Wu, No. 2, Lane 296, Ming Shent Road, Wu Feng Hsiang Taichung Hsien, Taiwan

[21] Appl. No.: 841,190

[22] Filed: Apr. 29, 1997

Related U.S. Application Data

[63] Continuation-in-part of Ser. No. 624,076, Mar. 29, 1996, abandoned.

[51] Int. Cl.[6] ..... F04B 19/02

[52] U.S. Cl. ..... 417/467; 417/468; 417/469; 417/487

[58] Field of Search ..... 417/460, 468, 417/469, 489, 540, 544, 569, 570, 467

[56] References Cited

U.S. PATENT DOCUMENTS

| | | | |
|---|---|---|---|
| 1,351,847 | 9/1920 | Gerhart | 417/468 |
| 2,348,190 | 5/1944 | Bullock | 417/544 |
| 4,012,174 | 3/1977 | Seibel et al. | 417/489 |
| 5,443,370 | 3/1995 | Wang | 417/469 |
| 5,507,626 | 4/1996 | Yang | 417/467 |

*Primary Examiner*—Charles G. Freay

*Attorney, Agent, or Firm*—Charles E. Baxley, Esq.

[57] ABSTRACT

A hand pump includes a cylindrical member having a cap secured on top and a cover securing the cap to the cylindrical member. A large piston is slidably engaged in the cylindrical member and a barrel secured to the large piston. A small piston is slidably engaged in the barrel for pumping air into the cylindrical member and the cover. The small piston may pump a low air pressure when the barrel is not secured to the cylindrical member and may pump a high air pressure when the barrel is secured to the cylindrical member.

6 Claims, 6 Drawing Sheets

HAND PUMP FOR PUMPING AIR OF LOWER PRESSURE AND HIGH PRESSURE

CROSS-REFERENCE TO RELATED APPLICATION

This is a continuation-in-part application of U.S. patent application Ser. No. 08/624,076 filed on Mar. 29, 1996, now abandoned.

BACKGROUND OF THE INVENTION

1. Field of the Invention

The present invention relates to a hand pump, and more particularly to a hand pump that is suitable for pumping air of lower pressure and for pumping air of higher pressure.

2. Description of the Prior Art

Typical hand pumps comprise one type for pumping air of lower pressure and the other type for pumping air of higher pressure. Normally, a bicycle user has to prepare one hand pump for pumping air having lower pressure into the tire and has to prepare another hand pump for pumping air of higher pressure into the air cushion devices for the bicycles.

The present invention has arisen to mitigate and/or obviate the afore-described disadvantages of the conventional hand pumps.

SUMMARY OF THE INVENTION

The primary objective of the present invention is to provide a hand pump which may be used for pumping air of lower pressure and may be converted into a different configuration for pumping air of higher pressure.

A hand pump in accordance with the present invention comprises:

- a cylindrical body for receiving air therein, the cylindrical body including an upper portion and a lower portion,
- an upper cap engaged in the upper portion of the cylindrical body and including a bore defined therein,
- a cover secured on top of the cylindrical body for securing the upper cap in place, the cover including a room defined therein and communicating with the bore of the upper cap,
- an outlet means having an outlet in fluid communication with the room of the cover,
- a relatively large piston slidably engaged in the cylindrical body and including an aperture defined therein, the large piston including a barrel extended downward therefrom,
- a relatively small piston slidably engaged in the barrel for pumping air in the barrel into the cylindrical body via the aperture of the relatively large piston and for pumping the air into the room of the cover via the bore of the upper cap, and
- a fastening means for releasably fastening the barrel to the cylindrical body and for engaging the large piston with the upper cap.

The relatively small piston is moved in a reciprocating action in the barrel so as to pump pressurized air below a pre-determined value to the outlet of the outlet means via the cylindrical body and the room when the fastening means is disengaged from the cylindrical body. The relatively small piston is moved in the reciprocating action in the barrel so as to pump pressurized air higher than the pre-determined value to the outlet of the outlet means via the cylindrical body and the room when the fastening means secures the barrel to the cylindrical body and engages the relatively large piston to the upper cap.

The relatively upper cap includes a center portion having a check valve engaged therein for allowing air to flow outward of the cylindrical body into the room of the cover and for preventing air to flow into the cylindrical body via the check valve.

The upper cap includes an orifice defined therein and includes a slide slidably received in the orifice of the cap. The cover includes a low pressure gauge and a high pressure gauge engaged therein and includes a passage and a passageway communicating with the orifice and the room respectively. The slide includes an extension extended downward beyond the cap for releasably engaging with the relatively large piston. The upper cap includes a biasing means for biasing the slide downward and for disengaging the slide from the passage. The passage is blocked by the slide in order to prevent the air in the room from flowing into the passage when the extension is moved against the biasing means by the relatively large piston and when the relatively large piston is engaged with the upper cap by the fastening means.

The upper cap includes a bottom portion having a recess defined therein and having a tapered inner peripheral surface formed therein. The relatively large piston includes a bulge formed on top thereof for engaging with the recess of the upper cap.

The cover includes an annular flange extended radially inward therefrom, and wherein the outlet means comprises a tube having an upper end and a lower end extending through the annular flange. An enlarged head is formed on the lower end of the tube to prevent disengagement of the tube from the cover. The outlet mean further includes a nozzle mean attached to the upper end of the tube and having the outlet defined therein. The tube includes an outlet passage which intercommunicates the room and the outlet of the nozzle means.

The fastening mean comprises a lower cap secured to the lower portion of the body and including a bore defined therein for slidably engaging with the barrel, a sleeve engaged with a bottom end of the barrel and a lid secured to the bottom end of the barrel for engaging with the sleeve so as to secure the sleeve to the barrel, a ferrule rotatably engaged on the sleeve, and a spring engaged between the sleeve and the ferrule for biasing the ferrule downward to engage with the lid. The ferrule is threadedly engaged with the relatively lower cap so as to secure the barrel to the lower cap. The relatively small piston including a piston rod extended downward therefrom and extended through the lid so as to be moved in the reciprocating action within the barrel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
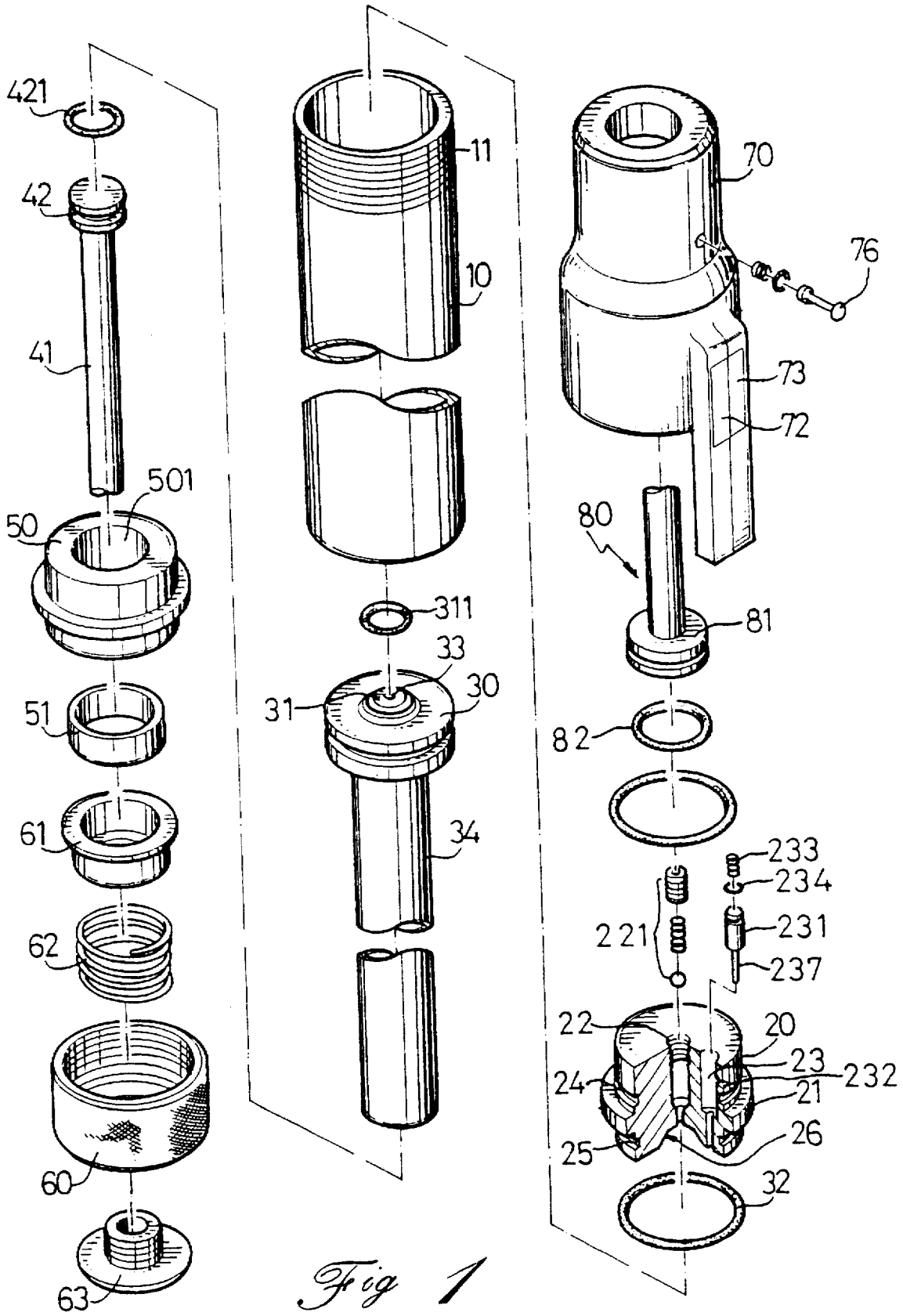
FIG. 1 is an exploded view of a hand pump in accordance with the present invention.
Figure 2:
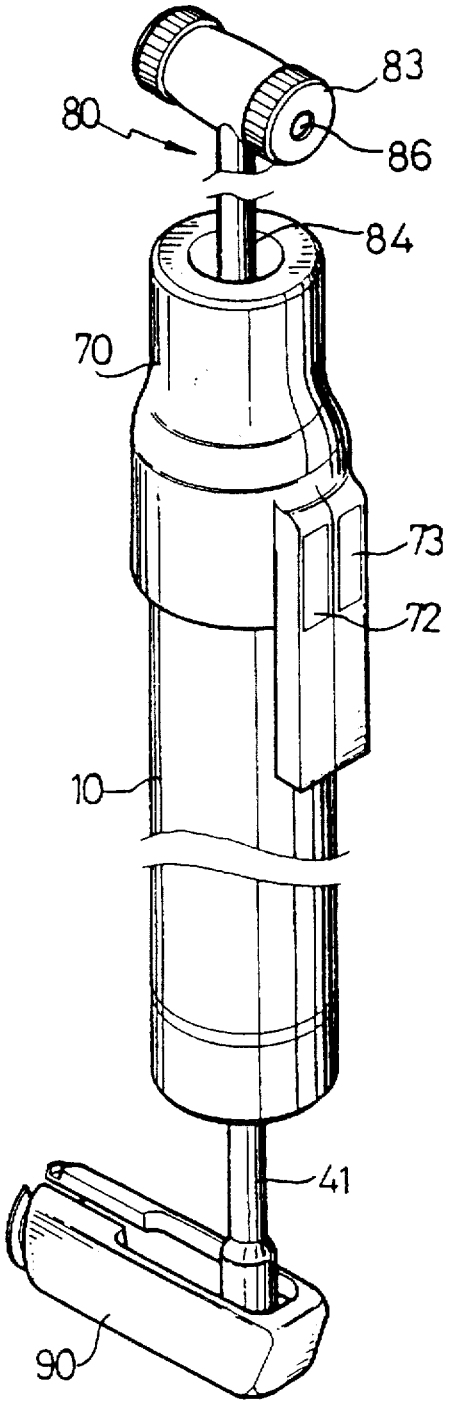
FIG. 2 is a perspective view of the hand pump.
Figure 3:
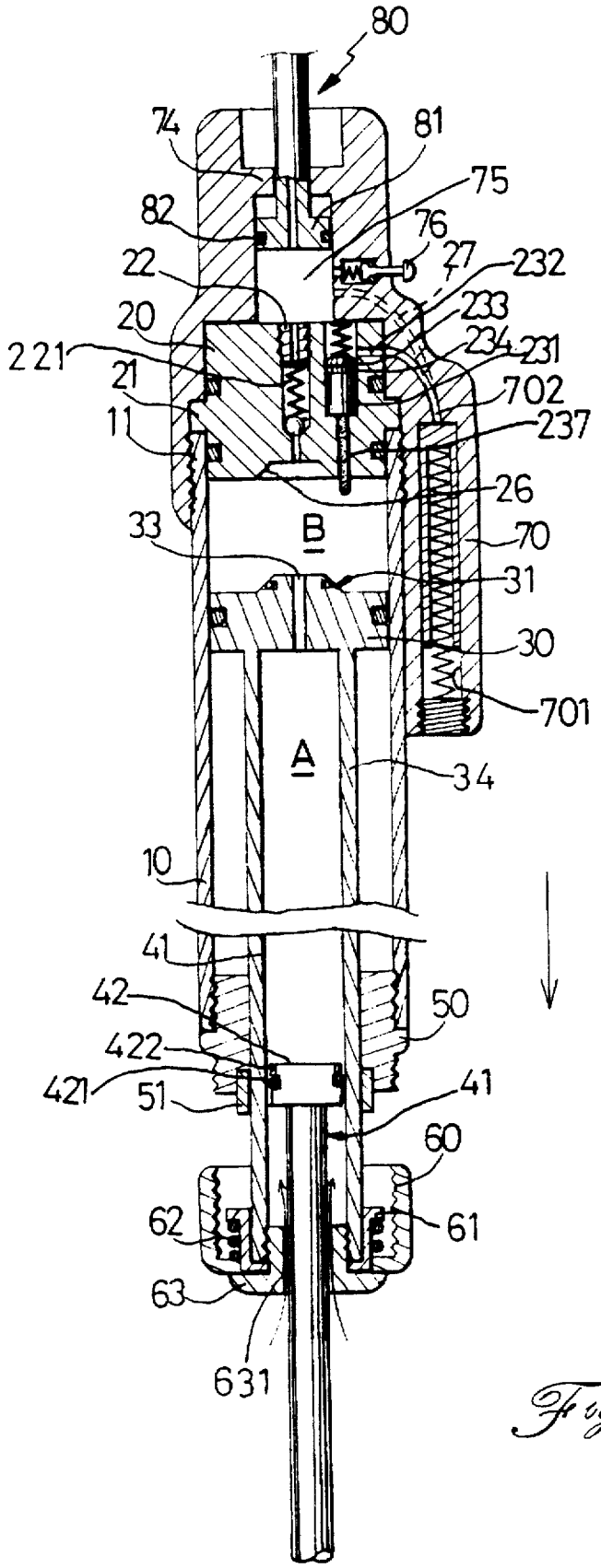
FIG. 3 is a cross sectional view illustrating an intake stroke of the hand pump for low pressure pumping.

Referring to the drawings, and initially to FIGS. 1 to 3, a hand pump in accordance with the present invention comprises a cylindrical body 10 including an upper portion having an outer thread 11 formed thereon and including a cap 20 engaged in top of the body 10. The cap 20 includes an annular flange 21 for engaging with the top of the body 10 so as to be secured to the body 10. The cap 20 further includes two annular grooves 24, 25 which are respectively defined above and below the annular flange 21 and each of which receives a sealing ring 32 therein. The cap 20 includes a bore 22 having an inner thread formed in the upper portion thereof. A check valve device 221 is engaged in the bore 22 and includes a ball and a spring engaged in the bore 22. The check valve device 221 further includes a screw engaged with the inner thread of the bore 22 for securing the ball and the spring within the bore 22, in which the screw includes a through hole formed therein so as to form the check valve. The cap 20 includes an orifice 23 defined beside the bore 22 thereof for receiving a slide 231 therein. The slide 231 includes a sealing ring 234 engaged thereon so as to form an air tight seal between the slide 231 and the cap 20 and includes an extension 237 extended downward beyond the cap 20. A spring 233 is engaged on top of the slide 231 for biasing the lower end of the slide 231 downward and for biasing the extension 237 downward beyond the cap 20. The cap 20 includes a passage 232 defined therein and communicating with the orifice 23. The cap 20 further includes a recess 26 defined in the bottom portion and having a tapered inner peripheral surface formed therein.

A cover 70 includes an inner thread formed in the bottom portion for threadedly engaging with the outer thread 11 of the body 10 so as to be secured to the body 10. The cover 70 includes a room 75 formed therein and includes an annular flange 74 extended radially inward therefrom. An outlet means 80 includes a tube 84 and a nozzle means 83 secured to an upper end of the tube 84. The tube 84 includes an enlarged head 81 formed in a lower end thereof in which the head 81 includes a sealing ring 82 engaged thereon for making an air tight seal between the cover 70 and the head 81. The tube 84 further includes an outlet passage 88 (FIG. 3) defined therein and communicating with an outlet 86 (FIG. 2) defined in the nozzle means 83. The cover 70 includes a chamber 701 defined therein and includes a passage 702 for intercommunicating with the chamber 701 with the passage 232 of the cap 20. The cover 70 includes a low pressure gauge 72 and a high pressure gauge 73 provided thereon and engaged in the chamber 701 and arranged to be viewed from outside of the cover 70. The cover 70 includes a passageway 27 (FIG. 3) defined therein for communicating the room 75 with the chamber 701. The low pressure gauge 72 is communicated with the passage 232 and the high pressure gauge 73 is communicated with the passageway 27. The cover 70 also includes a release valve 76 provided therein for releasing the pressurized air in the room 75.

A relatively large piston 30 is slidably engaged in the body 10 and engagable with the extension 237 of the slide 231, and includes a bulge 31 formed on top thereof for engaging with the recess 26 of the cap 20. A sealing ring 311 is engaged on the bulge 31 for making an air tight seal between the bulge 31 and the cap 20. The large piston 30 includes a barrel 34 extended downward therefrom and includes an aperture 33 communicating with the interior of the barrel 34. A sealing ring 32 is engaged in the large piston 30 for making an air tight seal between the large piston 30 and the body 10. A relatively small piston 42 is slidably engaged in the barrel 34 and includes an O-ring 421 engaged thereon for allowing smooth sliding movements of the piston 42 in the barrel 34. In addition, an annular notch 422 is defined in the small piston 42 to thereby allow environmental air to pass therethrough and thus enter the barrel 34. A lower cap 50 is secured to the bottom portion of the body 10 and includes a bore 501 defined therein for slidably engaging with the barrel 34 and includes a bushing 51 engaged between the lower cap 50 and the barrel 34. A sleeve 61 is engaged with the bottom end of the barrel 34 and a lid 63 is secured to the bottom of the barrel 34 for engaging with the sleeve 61 so as to secure the sleeve 61 to the barrel 34. A ferrule 60 is rotatably engaged on the sleeve 61 and a spring 62 is engaged between the sleeve 61 and the ferrule 60 for biasing the ferrule 60 downward to engage with the lid 63. The ferrule 60 may be threadedly engaged with the lower cap 50 so as to be secured to the lower cap 50. The small piston 42 includes a piston rod 41 extended downward therefrom and extended through the lid 63 for securing to a hand grip 90 (FIG. 2), such that the small piston 42 may be forced to move in a reciprocating action within the barrel 34 by the hand grip 90.

Figure 4:
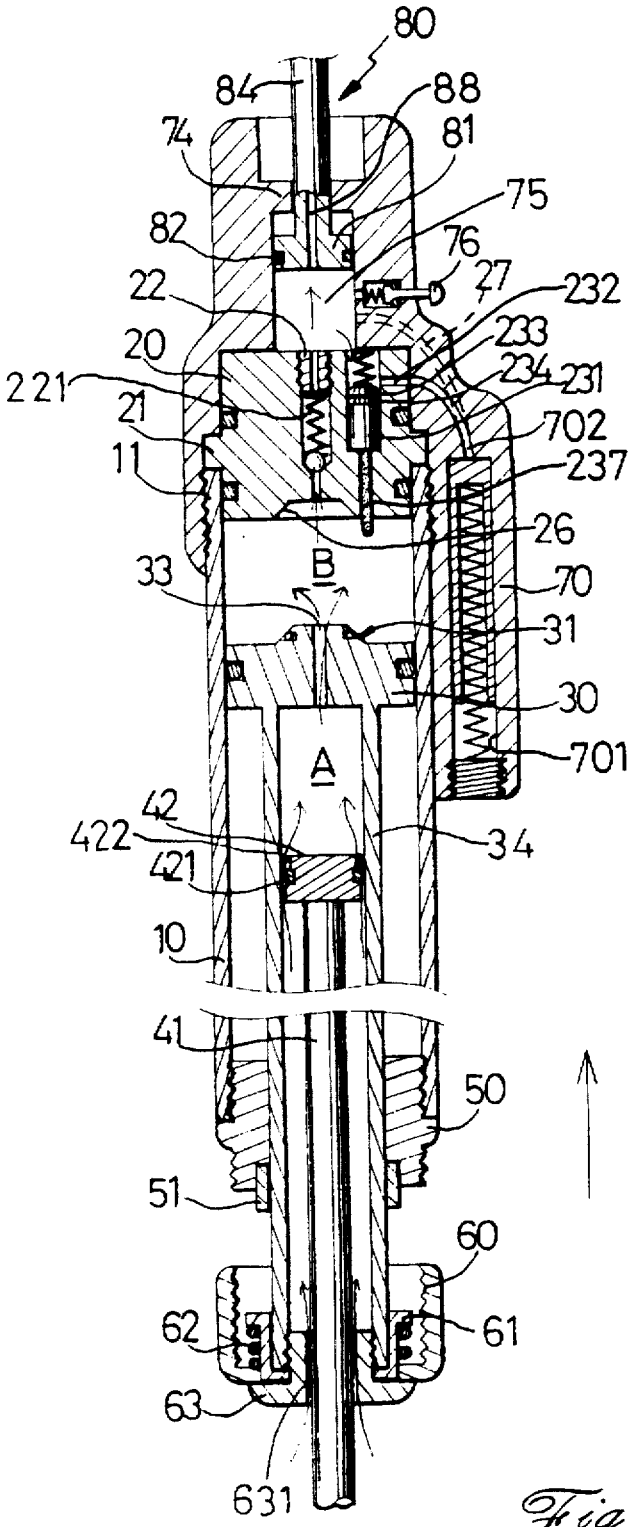
FIG. 4 is a cross sectional view illustrating an outlet stroke of the hand pump for low pressure pumping.

In low pressure pumping operation, the ferrule 60 is disengaged from the lower cap 50 and the small piston 42 is moved in the reciprocating action within the barrel 34 under manual operation of the hand grip 90 (FIG. 2). In an intake stroke, the small piston rod 41 is moved away from the large piston 30 (see FIG. 3), the environmental air enters the barrel 34 (chamber "A") via a gap defined between the lid 63 and the small piston 41 and via another gap defined between the small piston 42 and the barrel 34. In an outlet stroke, as shown in FIG. 4, the air contained in the barrel 34 (chamber "A") is pumped into the body 10 (chamber "B") via the aperture 33 of the large piston 30 and then exits the outlet 86 via the check valve 221, the room 75 of the cover 70, and the outlet passage 88. At this moment, the air pumped into the room 75 may be forced through the orifice 23 and the passage 232 and the passageway 27 and may be forced to actuate the low pressure gauge 72, and the user may read the pressure value from a display means (not labeled) provided on the low pressure gauge 72. It is to be noted that, at this moment, the low pressure air may not actuate the high pressure gauge 73. It is appreciated that environmental air enters the chamber "A" via the two gaps for compensation during the intake stroke. The configuration may be used for pumping air into a pressure ranging from 0 to e.g., 130 psi.

For high pressure pumping, more specifically, when the air within the room 75 reaches 130 psi, it is required to move the large piston 30 toward the cap 20 by the ferrule 60 and the ferrule 60 may be threadedly engaged with the lower cap 50 so as to stably secure the barrel 34 in the body 10. The bulge 31 of the large piston 30 engaged with the recess 26 of the cap 20 (i.e., the chamber "B" does not exit now) and the large piston 30 may force the slide 231 to move upward in order to block the passage 232 such that the pressurized air in the room 75 may not flow into the passage 232 and may not actuate the low pressure gauge 72 at this moment.

Figure 5:
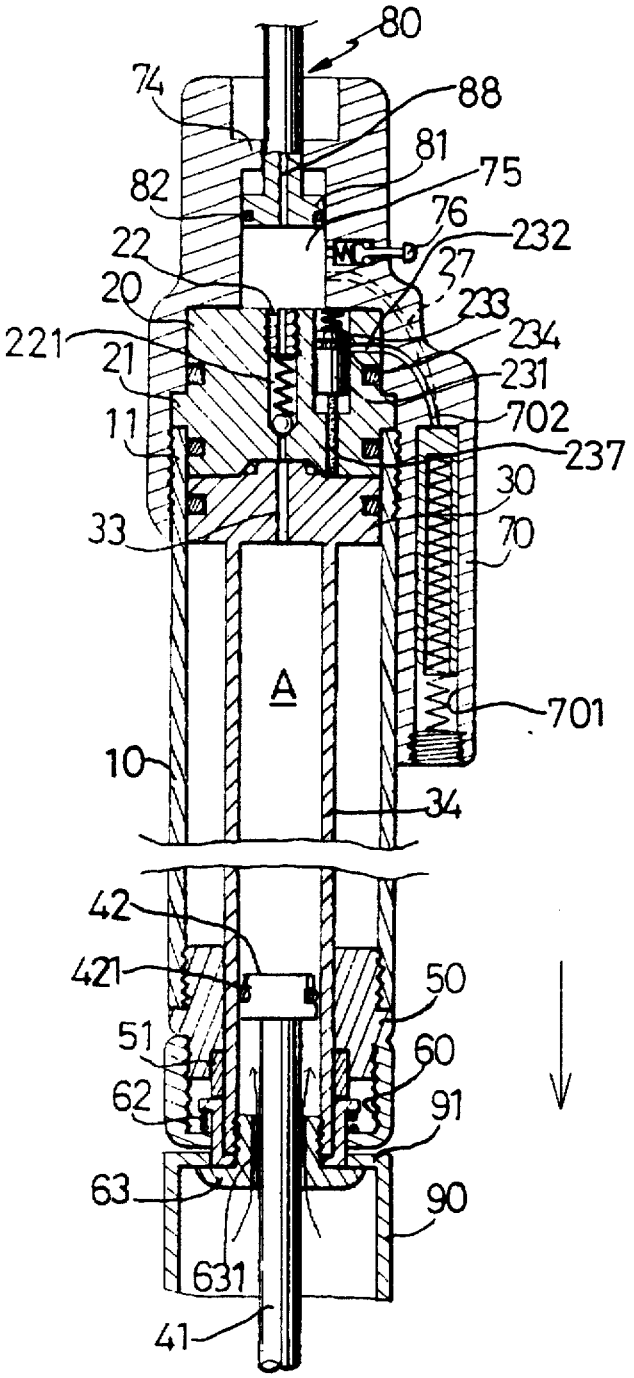
FIG. 5 is a cross sectional view illustrating an intake stroke of the hand pump for high pressure pumping.
Figure 6:
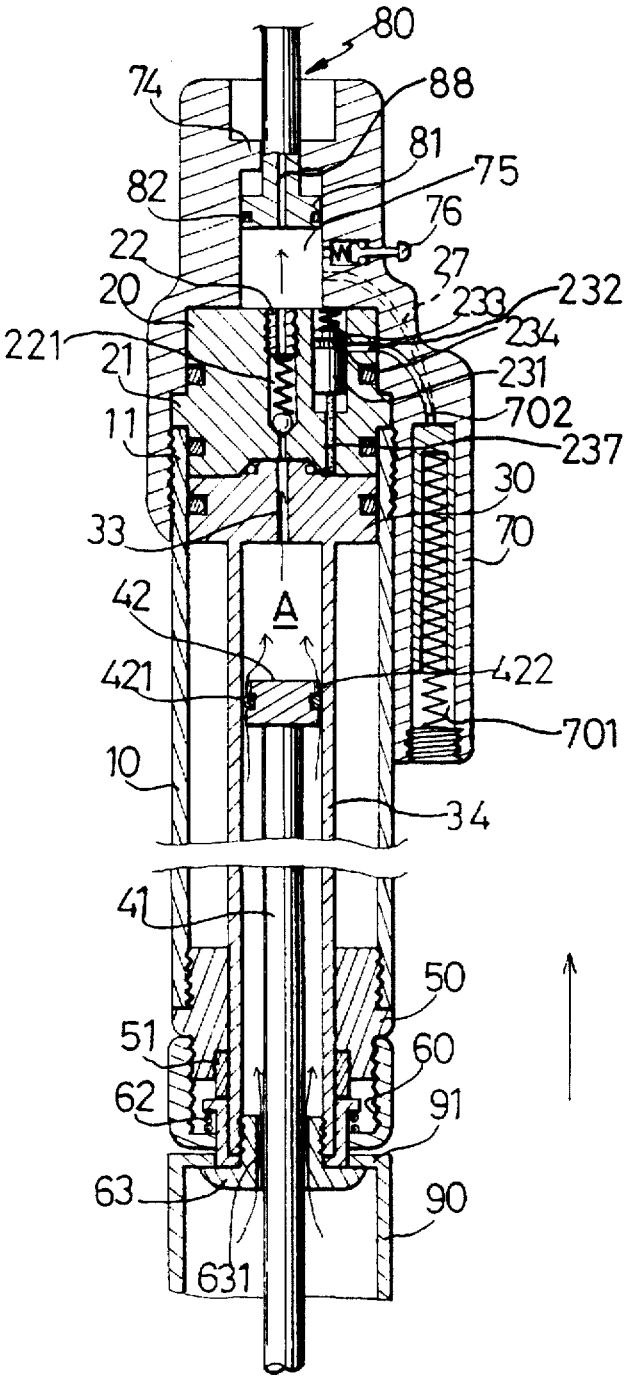
FIG. 6 is a cross sectional view illustrating an outlet stroke of the hand pump for high pressure pumping.

Referring to FIG. 5, in an intake stroke, the small piston rod 41 is moved away from the large piston 30, the environmental air enters the barrel 34 (chamber "A") via the gap defined between the lid 63 and the small piston 41 and via the gap defined between the small piston 42 and the barrel 34. In an outlet stroke, as shown in FIG. 6, the air contained in the barrel 34 (chamber "A") is pumped into the room 75 via the aperture 33 of the large piston 30 and the check valve 221 and then exits the outlet 86 via the outlet passage 88. The pressurized air may flow through the passageway 27 in order to actuate the high pressure gauge 73 at this moment. The air may be pumped to a pressure ranging from e.g., 130 psi to e.g., 260 psi. The user may read the pressure value from a display means (not labeled) provided on the high pressure gauge 73. It is appreciated that environmental air enters the chamber "A" via the two gaps for compensation during the intake stroke (FIG. 6).

Accordingly, the hand pump in accordance with the present invention includes a configuration the may be used for pumping low pressure air and that may be converted into a different configuration for pumping high pressure air according to the different pressure requirements.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump comprising:

a cylindrical body for receiving air therein, the cylindrical body including an upper portion and a lower portion, an upper cap engaged in the upper portion of said cylindrical body and including a bore defined therein, a cover secured on top of said cylindrical body for securing said upper cap in place, said cover including a room defined therein and communicating with said bore of said upper cap, an outlet means having an outlet in fluid communication with the room of the cover, a relatively large piston slidably engaged in said cylindrical body and including an aperture defined therein, said large piston including a barrel extended downward therefrom, a relatively small piston slidably engaged in said barrel for pumping air in said barrel into said cylindrical body via said aperture of said relatively large piston and for pumping the air into said room of said cover via said bore of said upper cap, and a fastening means for releasably fastening said barrel to said cylindrical body and for engaging said large piston with said upper cap, said relatively small piston being moved in a reciprocating action in said barrel so as to pump pressurized air below a pre-determined value to said outlet of said outlet means via said cylindrical body and said room when said fastening means is disengaged from said cylindrical body, and said relatively small piston being moved in the reciprocating action in said barrel so as to pump pressurized air higher than the pre-determined value to said outlet of said outlet means via said cylindrical body and said room when said fastening means secures said barrel to said cylindrical body and engages said relatively large piston to said upper cap.

2. A hand pump according to claim 1, wherein said relatively upper cap includes a center portion having a check valve engaged therein for allowing air to flow outward of said cylindrical body into said room of said cover and for preventing air to flow into said cylindrical body via said check valve.

3. A hand pump according to claim 1, wherein said upper cap includes an orifice defined therein and includes a slide slidably received in said orifice of said cap, said cover includes a low pressure gauge and a high pressure gauge engaged therein and includes a passage and a passageway communicating with said orifice and said room respectively, said slide includes an extension extended downward beyond said cap for releasably engaging with said relatively large piston, said upper cap includes a biasing means for biasing said slide downward and for disengaging said slide from said passage, said passage is blocked by said slide in order to prevent the air in said room from flowing into said passage when said extension is moved against said biasing means by said relatively large piston and when said relatively large piston is engaged with said upper cap by said fastening means.

4. A hand pump according to claim 1, wherein said upper cap includes a bottom portion having a recess defined therein and having a tapered inner peripheral surface formed therein, said relatively large piston includes a bulge formed on top thereof for engaging with said recess of said upper cap.

5. A hand pump according to claim 1, wherein said cover includes an annular flange extended radially inward therefrom, and wherein said outlet means comprises a tube having an upper end and a lower end extending through the annular flange, an enlarged head being formed on said lower end of said tube to prevent disengagement of said tube from said cover, said outlet means further includes a nozzle means attached to the upper end of the tube and having the outlet defined therein, the tube includes an outlet passage which intercommunicates the room and the outlet of the nozzle means.

6. A hand pump according to claim 1, wherein said fastening means comprises a lower cap secured to said lower portion of said body and including a bore defined therein for slidably engaging with said barrel, a sleeve engaged with a bottom end of said barrel and a lid secured to said bottom end of said barrel for engaging with said sleeve so as to secure said sleeve to said barrel, a ferrule rotatably engaged on said sleeve, and a spring engaged between said sleeve and said ferrule for biasing said ferrule downward to engage with said lid, said ferrule being threadedly engaged with said relatively lower cap so as to secure said barrel to said lower cap, said relatively small piston including a piston rod extended downward therefrom and extended through said lid so as to be moved in the reciprocating action within said barrel.

* * * * *